US010583479B2

(12) United States Patent
Taylor

(10) Patent No.: US 10,583,479 B2
(45) Date of Patent: Mar. 10, 2020

(54) AUTOMATED BI-CASTING

(71) Applicant: Rolls-Royce Corporation, Indianapolis, IN (US)

(72) Inventor: Duncan Philip Taylor, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 483 days.

(21) Appl. No.: 15/187,295

(22) Filed: Jun. 20, 2016

(65) Prior Publication Data

US 2016/0375487 A1 Dec. 29, 2016

Related U.S. Application Data

(60) Provisional application No. 62/183,602, filed on Jun. 23, 2015.

(51) Int. Cl.
*B22D 19/04* (2006.01)
*B22D 27/04* (2006.01)
(Continued)

(52) U.S. Cl.
CPC ..... *B22D 33/02* (2013.01); *B22D 19/02* (2013.01); *B22D 19/04* (2013.01); *B22D 19/16* (2013.01); *B22D 27/04* (2013.01); *B22D 27/15* (2013.01); *B22D 30/00* (2013.01); *B22D 35/04* (2013.01); *B22D 41/04* (2013.01); *F27D 7/06* (2013.01);
(Continued)

(58) Field of Classification Search
CPC ..... B22D 19/04; B22D 27/04; B22D 27/045
See application file for complete search history.

(56) References Cited

U.S. PATENT DOCUMENTS 2,326,164 A 8/1943 Payne
3,470,941 A 10/1969 Thompson
(Continued)

FOREIGN PATENT DOCUMENTS

EP 0559251 A1 9/1993

OTHER PUBLICATIONS

Notice of Intent to Grant and Text Intended to Grant from counterpart European Application No. 16175688.7, dated Oct. 1, 2018, 27 pp.

(Continued)

*Primary Examiner* — Kevin E Yoon
(74) *Attorney, Agent, or Firm* — Shumaker & Sieffert, P.A.

(57) ABSTRACT

Example systems include a vacuum chamber enclosing a pouring cup and a platform configured to support a casting assembly. The casting assembly is configured to hold a plurality of joinable components and a mold defining at least one mating groove configured to join at least two joinable components of the plurality of joinable components when occupied with a metal or an alloy. Each respective mating groove is fluidically connected to a respective surface opening of a plurality of surface openings defined by the mold. The pouring cup and the respective surface opening are movable relative to each other by moving at least one of the pouring cup or the platform supporting the casting assembly to substantially align the pouring cup with the respective surface opening. The pouring cup is configured to pour a respective volume of molten metal or alloy in at least two surface openings.

19 Claims, 2 Drawing Sheets

(51) Int. Cl.

| | |
|---|---|
| ***B22D 41/04*** | (2006.01) |
| ***B22D 33/02*** | (2006.01) |
| ***B22D 27/15*** | (2006.01) |
| ***B22D 35/04*** | (2006.01) |
| ***B22D 30/00*** | (2006.01) |
| ***F27D 9/00*** | (2006.01) |
| ***F27D 7/06*** | (2006.01) |
| ***B22D 19/02*** | (2006.01) |
| ***B22D 19/16*** | (2006.01) |

(52) U.S. Cl.
CPC ..... *F27D 9/00* (2013.01); *F27D 2007/066* (2013.01); *F27D 2009/007* (2013.01)

(56) References Cited

U.S. PATENT DOCUMENTS 4,008,052 A * 2/1977 Vishnevsky ..... B22D 19/04 164/100
4,066,116 A * 1/1978 Blazek ..... B22C 9/04 164/17
4,728,258 A * 3/1988 Blazek ..... B22C 9/04 415/137
4,813,470 A * 3/1989 Chiang ..... B22D 27/045 164/122.1
4,961,459 A * 10/1990 Blazek ..... B22C 9/04 164/10
4,978,039 A 12/1990 Brun et al.
5,000,244 A * 3/1991 Osborne ..... B22C 9/046 164/34
6,308,767 B1 * 10/2001 Hugo ..... B22D 27/045 164/122.1
6,425,435 B1 7/2002 Macheske et al.
6,446,701 B1 * 9/2002 Das ..... B22D 27/045 164/122.2
7,278,820 B2 10/2007 Keller
7,849,910 B2 12/2010 Graham
7,900,686 B2 3/2011 Kanayama et al.
8,801,388 B2 8/2014 Ortiz
2008/0196856 A1 * 8/2008 Terada ..... B22D 39/00 164/136
2008/0219853 A1 * 9/2008 Baker ..... F01D 5/02 416/241 R
2013/0156550 A1 6/2013 Franks et al.

OTHER PUBLICATIONS

Examination Report from counterpart European Application No. 16175688.7, dated Jul. 5, 2017, 4 pp.
Extended European Search Report from counterpart European Application No. 16175688.7, dated Sep. 29, 2016, 5 pp.
Response to Examination Report dated Jul. 5, 2017, from counterpart European Application No. 16175688.7, filed Nov. 1, 2017, 6 pp.

* cited by examiner

AUTOMATED BI-CASTING

This application claims the benefit of U.S. Provisional Application No. 62/183,602 filed Jun. 23, 2015, which is incorporated herein by reference in its entirety.

TECHNICAL FIELD

The disclosure relates to automated bi-casting.

BACKGROUND

Metal casting involves pouring molten metal or alloy into a mold, and allowing the poured molten material to cool and solidify into an object shaped by the mold. The object may be retrieved from the mold, for example, by breaking or disassembling the mold.

SUMMARY

In some examples, a system includes a vacuum chamber enclosing a pouring cup and a platform configured to support a casting assembly. In some examples, the casting assembly is configured to hold a plurality of joinable components and a mold defining at least one mating groove configured to join at least two joinable components of the plurality of joinable components when occupied with a metal or an alloy. Each respective mating groove of the at least one mating groove may be fluidically connected to a respective surface opening of a plurality of surface openings defined by the mold. In some examples, the pouring cup and the respective surface opening of the plurality of surface openings are movable relative to each other by moving at least one of the pouring cup or the platform to substantially align the pouring cup with respective surface openings of the plurality of surface openings. In some examples, the pouring cup is configured to pour a respective volume of molten metal or alloy in at least two surface openings of the plurality of surface openings.

In some examples, a technique includes substantially aligning a pouring cup with a first surface opening of a plurality of surface openings defined by a mold by moving at least one of the pouring cup or a platform supporting a casting assembly. In some examples, the casting assembly is configured to hold a plurality of joinable components and the mold, wherein the mold defines at least one mating groove configured to join at least two joinable components of the plurality of joinable components when occupied with a metal or an alloy. In some examples, each mating groove of the at least one mating groove is fluidically connected to a respective surface opening of the plurality of surface openings, and a vacuum chamber encloses the pouring cup, the casting assembly, and the platform. In some examples, the technique includes moving the pouring cup to pour a respective volume of molten metal or alloy in the first surface opening. In some examples, the technique includes substantially aligning the pouring cup with a second surface opening of the plurality of surface openings at least by moving at least one of the pouring cup and the platform. In some examples, the technique includes moving the pouring cup to pour a respective volume of molten metal or alloy in the second surface opening.

In some examples, a computer readable storage medium includes instructions that, when executed, cause at least one processor to control at least one of a cup controller to move a pouring cup and a platform controller to at least move a platform supporting a casting assembly to substantially align the pouring cup with a first surface opening of a plurality of surface openings defined by a mold. In some examples, the casting assembly is configured to hold a plurality of joinable components and the mold, wherein the mold defines at least one mating groove configured to join at least two joinable components of the plurality of joinable components when occupied with a metal or an alloy. In some examples, each mating groove of the at least one mating groove may be fluidically connected to a respective surface opening of the plurality of surface openings. In some examples, a vacuum chamber may enclose the pouring cup, the casting assembly, and the platform. In some examples, the computer readable storage medium further includes instructions that, when executed, cause the at least one processor to control the cup controller to move the pouring cup to pour a respective volume of molten metal or alloy in the first surface opening. In some examples, the computer readable storage medium further includes instructions that, when executed, cause the at least one processor to control at least one of the cup controller to move the pouring cup and the platform controller to move the platform to substantially align the pouring cup with a second surface opening of the plurality of surface openings. In some examples, the computer readable storage medium further includes instructions that, when executed, cause the at least one processor to control the cup controller to move the pouring cup to pour a respective volume of molten metal or alloy in the second surface opening.

The details of one or more examples are set forth in the accompanying drawings and the description below. Other features, objects, and advantages will be apparent from the description and drawings, and from the claims.

DETAILED DESCRIPTION

In general, the disclosure describes systems and techniques for bi-casting. In some examples, the systems and techniques described herein may facilitate more efficient use of material in bi-casting, more efficient heating, or both. Bi-casting systems described herein may include a pouring cup and a casting assembly that includes a plurality of surface openings configured to receive molten metal or alloy and direct the molten metal or alloy to a mold. The pouring cup may be movable relative to the surface openings, the casting assembly may be movable relative to the pouring cup, or both, such that the pouring cup may be substantially aligned (e.g., aligned or nearly aligned) with respective surface openings to pour respective charges of molten metal or alloy in the respective surface openings. By pouring respective charges of molten metal or alloy in each of a plurality of surface openings, in some examples, the total amount of molten metal or alloy used in the bi-casting technique may be less than if a single opening is used, e.g., due to shorter pathways from the surface openings to the mold.

As described herein, bi-casting may be used to cast a first metal or alloy (the molten metal or alloy) on or adjacent to a second metal or alloy by pouring a molten volume of the first metal or alloy on or adjacent to the second metal or alloy. In some examples, a joint including the first metal or alloy may be cast to join joinable components including the second metal or alloy. In some examples, the pouring cup and the casting assembly may be enclosed in a vacuum chamber and maintained under vacuum during the pouring process, which may reduce or substantially prevent (e.g., prevent or nearly prevent) air bubbles from forming in the casted joint, reduce or substantially prevent (e.g., prevent or nearly prevent) reaction of atmospheric species with the molten metal or alloy, or both. Further, in some examples, the casting assembly may be supported by a platform, which may move the casting assembly between a heating zone and a cooling zone. Example systems described herein may be used to fabricate articles including a plurality of joinable components joined by at least one casted joint.

Figure 1:
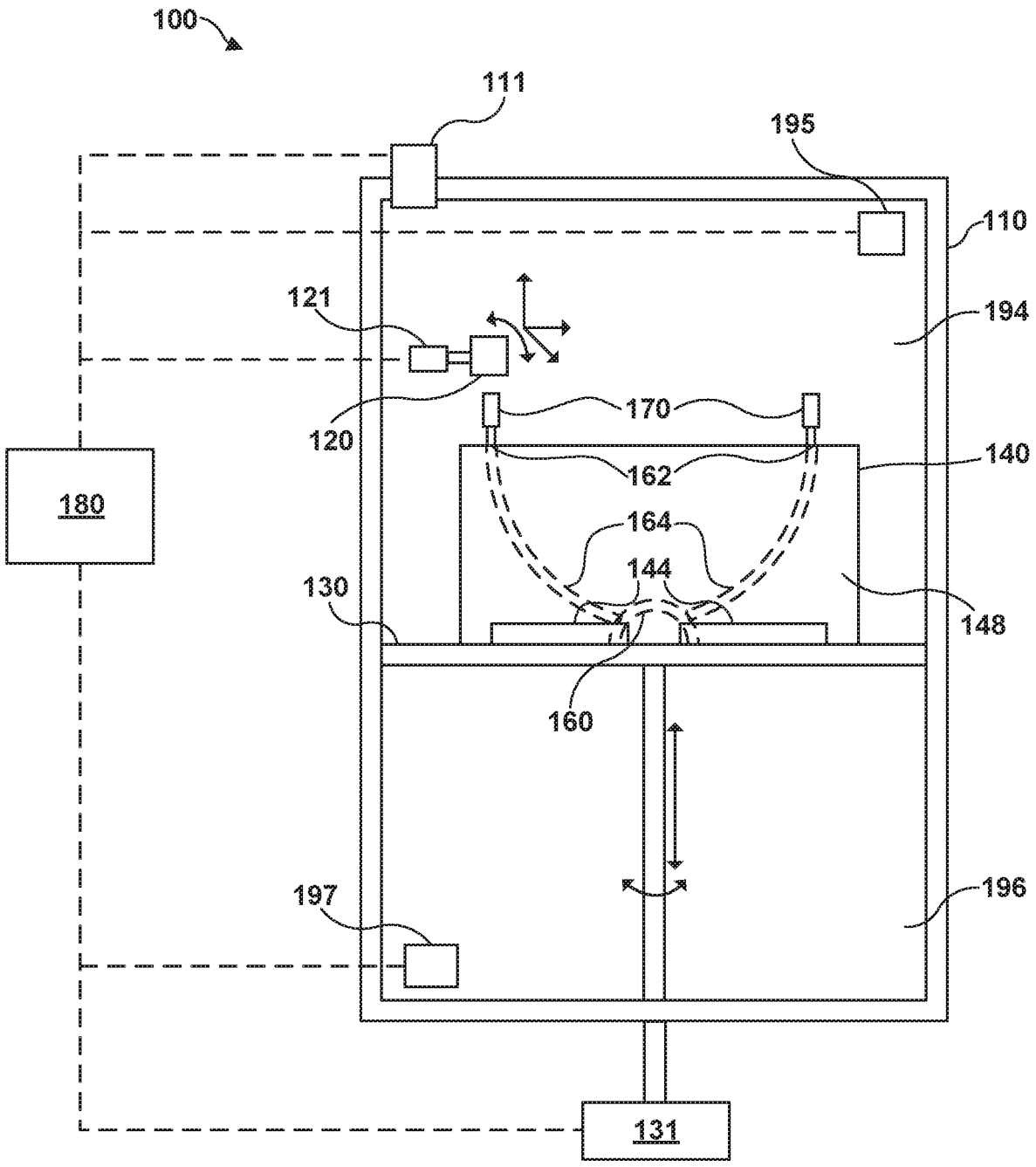
FIG. 1 is a conceptual and schematic diagram illustrating an example system for automated bi-casting.

FIG. 1 is a conceptual and schematic diagram illustrating an example system 100 for automated bi-casting. System 100 includes a vacuum chamber 110, a pouring cup 120, and a platform 130 that supports a casting assembly 140. In some examples, system 100 may include a computing device 180 that controls at least one of a cup controller 121, a platform controller 131, a vacuum controller 111, a heating zone controller 195, and a cooling zone controller 197, so that computing device 180 may control system 100 to perform bi-casting techniques. System 100 also may include the at least one of cup controller 121, platform controller 131, vacuum controller 111, heating zone controller 195, and cooling zone controller 197.

In some examples, vacuum chamber 110 encloses pouring cup 120, platform 130, and casting assembly 140 to maintain an appropriate pressure or a substantial vacuum (e.g., a vacuum or nearly a vacuum) during at least one stage of processing, including casting. In some examples, vacuum chamber 110 includes a heating zone 194 and a cooling zone 196.

Heating zone 194 may be a zone or sub-chamber within vacuum chamber 110 that is heated to or maintained at an elevated temperature, for instance, for pre-heating casting assembly 140. In some examples, system 100 includes heating zone controller 195 configured to control heating of heating zone 194. For example, heating zone controller 195 may include a thermostat and a heating source configured to supply heat to heating zone 194 by at least one of conduction, convection, or radiation. In some examples, the temperature to which heating zone 194 is heated may be a temperature at which the metal or alloy to be poured from pouring cup 120 is molten. In some examples, heating zone controller 195 may substantially maintain (e.g., maintain or nearly maintain) heating zone 194 at a predetermined temperature, e.g., a temperature at which the metal or alloy to be poured from pouring cup 120 is molten.

In some examples, casting assembly 140 may be pre-heated externally of system 100, and introduced into vacuum chamber 110 after pre-heating. For example, pre-heated casting assembly may be introduced into heating zone 194 of vacuum chamber 110, and vacuum controller 111 may pull a vacuum within heating zone 194 of chamber 110. In some examples, heating zone controller 195 may control the temperature of heating zone 194 to be substantially equal to the temperature of pre-heated casting assembly 140 introduced into heating zone 194.

In some examples, vacuum chamber 110 also includes a cooling zone 196 for cooling casting assembly 140 after pouring of the molten metal or alloy into at least one mating groove 160. In some examples, system 100 includes cooling zone controller 197 configured to control a temperature of cooling zone 196. For example, cooling zone controller 197 may include a forced convection cooling system and a thermostat, to control the temperature of cooling zone 196. In some examples, cooling zone controller 197 may control the temperature of cooling zone 196 to be a temperature at which the metal or alloy poured from pouring cup 120 is solid. Hence, when platform 130 and casting assembly 140 move to cooling zone 196, the molten metal or alloy in at least one mating groove 160 may cool and solidify. In some examples, cooling zone controller 197 may substantially maintain (e.g., maintain or nearly maintain) cooling zone 196 at a predetermined temperature, e.g., a temperature at which the metal or alloy poured from pouring cup 120 is solid. In some examples, cooling zone controller 197 may control the temperature of cooling zone 196 according to an annealing program by cooling the temperature of cooling zone 196 to various intermediate selected temperatures and holding the respective selected intermediate temperatures for respective predetermined periods of time. For example, cooling zone controller 197 may control the temperature of cooling zone 196 over a period of time to anneal the poured volume of metal or alloy within mating groove 160.

While heating zone 194 may be disposed vertically above cooling zone 196 in some examples, as shown in FIG. 1, in other examples, heating zone 194 may be disposed below cooling zone 196. In still other examples, heating zone 194 may be disposed in a horizontal relation to cooling zone 196. For example, heating zone 194 may be horizontally adjacent to cooling zone 196. In some examples, vacuum chamber 110 includes thermal insulation, for instance, an insulating lining, for thermally insulating the interior of vacuum chamber 110 from the environment exterior to vacuum chamber 110. In some examples, the insulating lining thermally insulates at least one of heating zone 194 and cooling zone 196 from the environment outside the vacuum chamber, from each other, or both. In some examples, heating zone 194 and cooling zone 196 may be separated by a valve, door, hatch, or the like.

While system 100 has been described with reference to vacuum chamber 110 in examples above, in other examples, system 100 may include a chamber that is exposed to the atmosphere, or otherwise does not maintain a vacuum.

In some examples, system 100 includes platform 130 configured to support and move casting assembly 140 and a platform controller 131 configured to control movement of platform 130. Platform 130 may include a base capable of supporting casting assembly 140. Computing device 180 may control platform controller 131 to move platform 130 by at least one of rotating or translating platform 130. For example, platform controller 131 may include a rotary lift configured to raise, lower, and rotate platform 130. In some examples, platform controller 131 may vertically translate platform 130, moving casting assembly 140 between an upper region and a lower region of the vacuum chamber (e.g., heating zone 194 and cooling zone 196). In some examples, platform controller 131 may translate platform 130 horizontally, so that casting assembly 140 is moved horizontally within vacuum chamber 110. In some examples, platform controller 131 may rotate platform 130 about an axis normal to a major surface of platform 130. For example, platform 131 may rotate platform 130 about an axis passing through casting assembly 140. Because platform 130 supports casting assembly 140, computing device 180 may thus control platform controller 131 to locate and orient casting assembly 140 within vacuum chamber 110, for example, relative to pouring cup 120, or between heating zone 194 and cooling zone 196.

Casting assembly 140 is configured to hold a plurality of joinable components 144. Each joinable component of plurality of joinable components 144 may include a metal or alloy. The metal or alloy in each respective joinable component of plurality of joinable components 144 may be the same or may be different. In some examples, the metal or alloy may include alloys such as Fe-based, Ni-based, or Co-based superalloys. For example, the metal or alloy may include CMSX-4 Ni-based superalloy. In some examples, the metal or alloy in each joinable component of plurality of joinable components 144 is different from the molten metal or alloy in pouring cup 120. For example, the molten metal or alloy in pouring cup 120 may include Fe-based, Ni-based, or Co-based superalloy that is different from the metal or alloy in each joinable component of plurality of joinable components 144. In other examples, the metal or alloy in each joinable component of plurality of joinable components 144 may be the same as the molten metal or alloy in pouring cup 120.

Casting assembly 140 may position the plurality of joinable components 144 to define a predetermined shape. In some examples, each joinable component of the plurality of joinable components 144 may define a joint region which, when filled by a solid material, joins the plurality of joinable components 144. In some examples, casting assembly 140 includes a mold 148, which defines a mating groove 160 that, in combination with the joint regions of plurality of joinable components 144, defines the shape of the joint. In some examples, mating groove 160 defines a clip for joining respective joinable components of plurality of joinable components 144. For example, mold 148 may define mating groove 160 as including a semi-circular channel. Mold 148 also defines a plurality of surface openings 162, and at least one channel 164 that fluidically connects a respective mating groove of the at least one mating groove 160 to a respective surface opening of a plurality of surface openings 162.

In some examples, respective surface openings of plurality of surface openings 162 receive a first metal or alloy from cup 120 and the molten metal or alloy flows through respective channels of at least one channel 164 to mating groove 160, around or adjacent each joinable component of plurality of joinable components 144. In some examples, after the first poured metal or alloy cools and solidifies, casting assembly 140 includes at least two joinable components of the plurality of joinable components 144 joined by the first metal or alloy. Plurality of joinable components 144 may include components of a high temperature mechanical system (e.g., a turbine), and casting assembly 140 may position the components in the orientation to be eventually assumed in the final article formed after the poured molten volume of metal or alloy occupies and solidifies within mating groove 160.

In some examples, respective surface openings of plurality of surface openings 162 may be narrow, and it may be difficult to control the stream of molten metal or alloy poured from cup 120 to accurately enter a respective surface opening without spilling. In some examples, casting assembly 140 includes a plurality of pour tubes 170, each pour tube connected to a respective surface opening of plurality of surface openings 162. In some examples, each pour tube of plurality of pour tubes 170 includes an inlet for accepting poured molten metal or alloy from pouring cup 120 and an outlet for directing the molten metal or alloy to a respective surface opening of plurality of surface openings 162. In some examples, the inlet of each pour tube of plurality of pour tubes 170 may at least be wider than a respective surface opening of plurality of surface openings 162, or at least be sufficiently wide to receive the stream of molten metal or alloy poured by pouring cup 120 without spilling outside the respective pour tube of plurality of pour tubes 170. In some examples, each pour tube of plurality of pour tubes 170 includes a funnel for directing the stream of molten metal or alloy poured from pouring cup 120 to a respective surface opening of plurality of surface openings 162.

To allow for uninterrupted passage of molten metal or alloy from plurality of surface openings 162 to groove 160, computing device 180 may control vacuum controller 111 to maintain casting assembly 140 under a vacuum at least while pouring molten metal or alloy from pouring cup 120, to prevent blockage by air (for instance, air bubbles) within casting assembly 140. For example, maintaining a vacuum while pouring molten metal or alloy into casting alloy 140 may prevent blockage plurality of surface openings 162, at least one channel 164, or mating groove 160. Maintaining a vacuum may also provide other advantages, for example, preventing oxidation or other reactions of atmospheric species with the molten metal or alloy.

System 100 includes poring cup 120 for pouring molten metal or alloy into casting assembly 140 and a cup controller 121 that controls motion of poring cup 120. In some examples, computing device 180 may control cup controller 121 to move pouring cup 120 by at least one of rotating around at least one axis or translating along at least one axis. For example, cup controller 121 may translate pouring cup 120 relative to a major surface of platform 130. In some examples, cup controller 121 may rotate pouring cup 120 about a horizontal axis to turn pouring cup 120 between a first configuration in which pouring cup 120 maintains the volume of molten metal or alloy and a second configuration in which pouring cup 120 pours the volume of molten metal or alloy.

Pouring cup 120 may contain a volume of molten metal or alloy to be poured into a casting assembly 140. Pouring cup 120 may include an inlet for charging molten metal or alloy into pouring cup 120. In some examples, pouring cup 120 may include a container in the shape of a cylinder, a cube, or any other shape that may contain the volume of molten metal or alloy. Pouring cup 120 may include at least one of a lip and a spout to direct the stream of poured volume of molten metal or alloy in a desired direction, for example, toward a surface of casting assembly 140. In some examples, pouring cup 120 may be initially or occasionally charged with solid metal or alloy, and may be heated to melt the metal or alloy into a molten volume.

Cup controller 121 may move pouring cup 120 by at least one of translating or rotating, to substantially align (e.g., align or nearly align) pouring cup 120 with regions, portions, or surfaces of casting assembly 140. For example, cup controller 121 may move pouring cup to substantially align (e.g., align or nearly align) pouring cup 120 with a respective surface opening of plurality of surface openings 162 or a respective pour tube of plurality of pour tubes 170. In some examples, cup controller 121 may move pouring cup 120 to turn between the first configuration and the second configuration to pour molten metal or alloy from pouring cup 120 to a respective surface opening of plurality of surface openings 162 or a respective pour tube of plurality of pour tubes 170. In some examples, the degree to which cup controller 121 turns pouring cup 120 affects the rate at which the volume of molten metal or alloy is poured, and affects the flow geometry of the poured stream of molten metal or alloy.

Pouring cup 120 and the respective surface opening of the plurality of surface openings 162 are movable relative to each other. For example, computing device 180 may control cup controller 121 to move pouring cup 120, or platform controller 131 to move platform 130 to move casting assembly 140, or both, to substantially align (e.g., align or nearly align) pouring cup 120 with respective surface openings of the plurality of surface openings 162. In some examples, computing device 180 may control cup controller 121 to move pouring cup 120 to pour a respective volume of molten metal or alloy in at least two respective surface openings of plurality of surface openings 162. For example, computing device 180 may control cup controller 121 to move pouring cup 120 to pour a respective volume of molten metal or alloy in a first surface opening of plurality of surface openings 162; may control cup controller 121, platform controller 131, or both to move pouring cup 120, platform 130, or both to substantially align (e.g., align or nearly align) pouring cup 120 with a second surface opening of plurality of surface openings 162; and control cup controller 121 to move pouring cup 120 to pour a respective volume of molten metal or alloy in the second surface opening of plurality of surface openings 162. In this way, system 100 facilitates pouring of liquid metal or alloy in respective surface openings of plurality of surface openings 162.

Thus, in some examples, system 100 may perform example techniques to fabricate articles including a plurality of joinable components joined by at least one casted joint. For example, system 100 may be used to fabricate a high temperature mechanical component that includes a plurality of joinable components including a first metal or alloy joined by joints including a second metal or alloy. By pouring molten metal or alloy into respective surface openings of plurality of surface openings 162, the system of FIG. 1 may facilitate more efficient use of material in bi-casting due to shorter channels 164 compared to examples including a single channel; more efficient heating due to less material to heat, or both.

Figure 2:
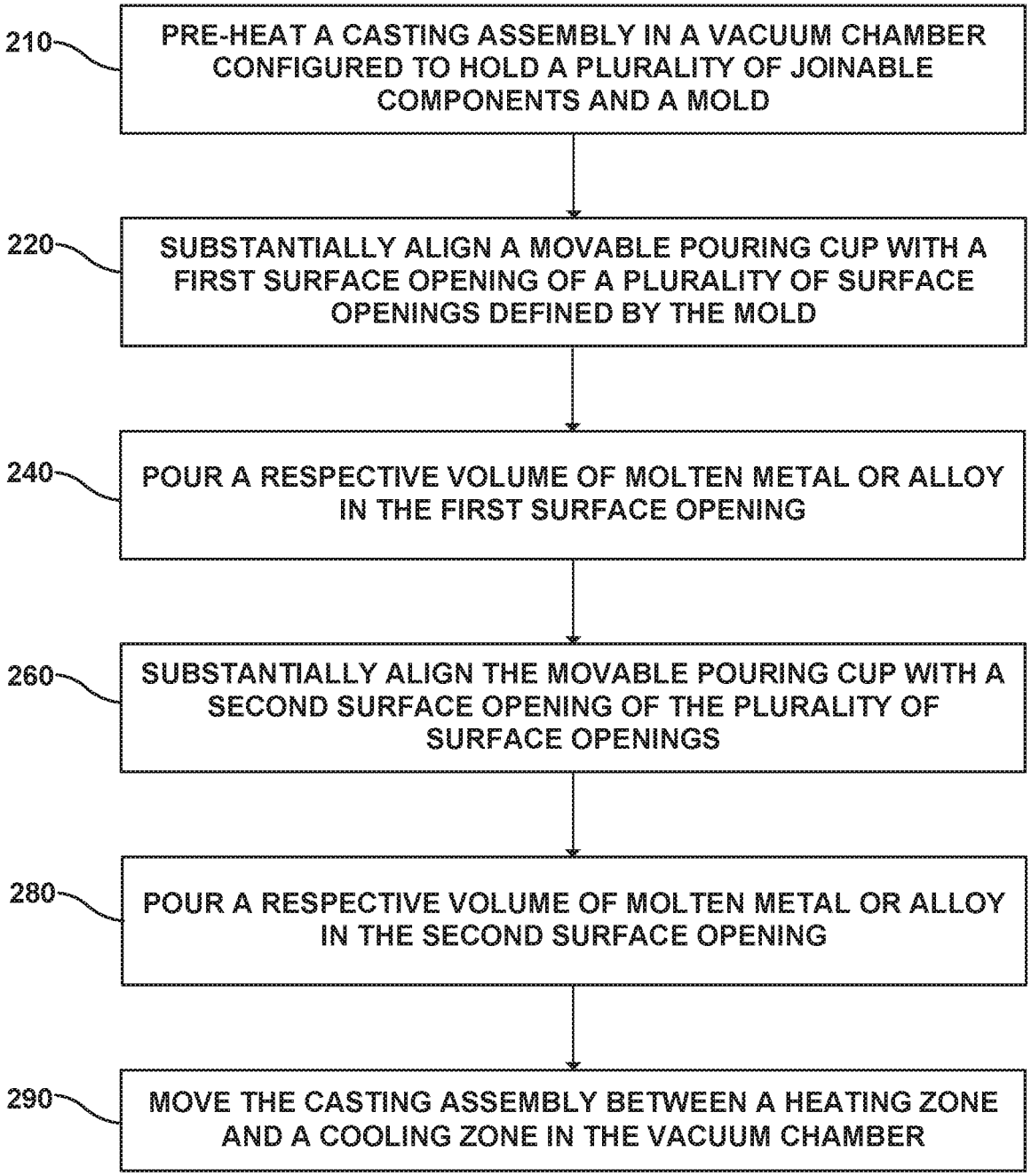
FIG. 2 is a flow diagram illustrating an example technique for automated bi-casting.

FIG. 2 illustrates a flow diagram of an example technique for automated bi-casting. The technique of FIG. 2 will be described with concurrent reference to system 100 of FIG. 1. However, it will be understood that a different system may perform the technique of FIG. 2, system 100 may perform other techniques, or both. In some examples, the technique of FIG. 2 includes substantially aligning (e.g., aligning or nearly aligning) pouring cup 120 with a first surface opening of plurality of surface openings 162 defined by mold 148 (220). In some examples, substantially aligning pouring cup 120 with the first surface opening (220) includes moving at least one of pouring cup 120 or platform 130 supporting casting assembly 140. As described above, in some examples, computing device 180 controls at least one of cup controller 121 or platform controller 131 to move at least one of pouring cup 120 or platform 130 to substantially align (e.g., align or nearly align) pouring cup 120 with the first surface opening (220).

In some examples, substantially aligning pouring cup 120 with the first surface opening of plurality of surface openings 162 includes aligning pouring cup 120 with a first pour tube of plurality of pour tubes 170, wherein each respective pour tube of plurality of pour tubes 170 is connected to one surface opening of plurality of surface openings 162. For example, pouring cup 120 may pour molten metal or alloy into respective pour tubes of plurality of pour tubes to accurately direct the poured metal or alloy to surface opening 162 and eventually to mating groove 160 without spilling metal or alloy outside mold 148 or at surfaces of casting assembly 140.

In some examples, the technique of FIG. 2 also includes moving pouring cup 120 to pour a respective volume of molten metal or alloy in the first surface opening (240). As described above, in some examples, computing device 180 controls cup controller 121 to move pouring cup 120 to pour a respective volume of molten metal or alloy in the first surface opening (240).

In some examples, the technique of FIG. 2 includes substantially aligning pouring cup 120 with a second surface opening of plurality of surface openings 162 by moving at least one of pouring cup 120 and platform 130 (260). In some examples, substantially aligning pouring cup 120 with the second surface opening includes at least one of translating or rotating platform 130. In some examples, substantially aligning pouring cup 120 with the second surface opening includes at least one of translating or rotating pouring cup 120. For example, one or both of platform 130 and pouring cup 120 may be rotated or translated to substantially align pouring cup 120 with the second surface opening. As described above, in some examples, computing device 180 controls at least one of cup controller 121 or platform controller 131 to move at least one of pouring cup 120 or platform 130 to substantially align (e.g., align or nearly align) pouring cup 120 with the second surface opening (260).

In some examples, the technique of FIG. 2 additionally includes moving pouring cup 120 to pour a respective volume of molten metal or alloy in the second surface opening (280). In some examples, the poured respective volume of molten metal or alloy is sufficient to occupy at least mating groove 160. For example, the respective volume of molten metal or alloy may occupy mating groove 160 to join respective joinable components of plurality of joinable components 144.

Although the technique of FIG. 2 includes substantially aligning pouring cup 120 with a first surface opening (220) and substantially aligning pouring cup 120 with a second surface opening (260), in other examples, casting assembly 140 may include more than two surface openings, and the technique of FIG. 2 may include additional aligning and pouring steps. In some examples, the technique of FIG. 2 may include as many aligning and pouring steps, respectively, as casting assembly 140 includes surface openings. In this way, in some examples, the technique of FIG. 2 may include pouring molten metal or alloy in each surface opening of plurality of surface openings 162 in casting assembly 140.

In some examples, the technique of FIG. 2 optionally includes moving platform 130 supporting casting assembly 140 between heating zone 194 and cooling zone 196 (290). For example, platform 130 may be moved to move casting assembly 140 to heating zone 194 prior to pouring of molten metal or alloy from pouring cup 120 (e.g., steps 220 and 240), and to move casting assembly to cooling zone 196 after pouring of molten metal or alloy to allow the molten metal or alloy to cool and solidify at least within mating groove 160. In some examples, the technique of FIG. 2 includes cooling the poured molten metal or alloy in cooling zone 196 to solidify the poured metal or alloy at least within mating groove 160 so that it can join respective joinable components of plurality of joinable components 144.

In some examples, the example technique of FIG. 2 optionally includes, before one or more of substantially aligning (220, 260) or pouring (240, 280), pre-heating casting assembly 140 to a predetermined temperature (210). For example, casting assembly 140 may be pre-heated to a temperature that is substantially equal to the temperature of the molten metal or alloy, for example, at least the melting point of molten metal or alloy in pouring cup 120. In some examples, casting assembly 140 is pre-heated externally to system 100, for instance, by subjecting casting assembly to an external heat source or heat zone for a predetermined period of time. For example, pre-heated casting assembly 140 may be introduced into vacuum chamber 110, for instance, within heating zone 194. In other examples, casting assembly 140 is pre-heated within system 100, for instance, by heating casting assembly 140 within heating zone 194.

In various example techniques, vacuum controller 111 may optionally pull vacuum within vacuum chamber 110 at one or more of pre-heating (210), substantially aligning (220, 260), pouring (240, 280), and moving (290). For example, vacuum chamber 110 may maintain substantially a vacuum at least while pouring the respective volume of molten metal or alloy in the first surface opening (240) and while pouring the respective volume of molten metal or alloy in the second surface opening (280), to avoid problems discussed above with reference to FIG. 1.

While example techniques described above may be performed substantially in vacuum, in other examples, example techniques may be performed at atmospheric pressure, or otherwise in systems that may not include a vacuum chamber.

Thus, example techniques of FIG. 2 may be used to fabricate articles including a plurality of joinable components joined by at least one casted joint. For example, system 100 may be used to fabricate a high temperature mechanical component that includes a plurality of joinable components including a first metal or alloy joined by joints including a second metal or alloy. While system 100 may be operated according to example techniques discussed with reference to FIG. 2, other example techniques may be used to operate system 100.

Various examples have been described. These and other examples are within the scope of the following claims.

The invention claimed is:

1. A system comprising:

a casting assembly;

a computing device; and a vacuum chamber enclosing a pouring cup and a platform configured to support the casting assembly, wherein:

the casting assembly is configured to hold a plurality of joinable components and includes a mold defining at least one mating groove configured to join at least two joinable components of the plurality of joinable components when occupied with a metal or an alloy, each respective mating groove of the at least one mating groove fluidically connected to a first surface opening and a second surface opening defined by the mold;

the pouring cup is movable relative to the first surface opening and the second surface opening by moving at least one of the pouring cup or the platform to substantially align the pouring cup with the first surface opening and, separately, to substantially align the pouring cup with the second surface opening; and the computing device is configured to control the pouring cup to pour a respective volume of the molten metal or alloy in the first surface opening separately from the second surface opening and to pour another respective volume of the molten metal or alloy in the second surface opening separately from the first surface opening, wherein the pouring cup is a single pouring cup.

2. The system of claim 1, further comprising a platform controller for moving, under the control of the computing device, the platform by at least one of rotating or translating.

3. The system of claim 2, wherein the platform controller comprises a rotary lift.

4. The system of claim 1, further comprising a cup controller for moving, under the control of the computing device, the pouring cup by at least one of rotating or translating.

5. The system of claim 1, wherein the vacuum chamber comprises a heating zone and a cooling zone, and wherein the platform is configured to move the casting assembly between the heating zone and the cooling zone of the vacuum chamber.

6. The system of claim 1, further comprising a first pour tube connected to the first surface opening and a second pour tube connected to the second surface opening, wherein the movement of at least one of the pouring cup or the casting assembly to substantially align the pouring cup with the first surface opening and, separately, to substantially align the pouring cup with the second surface opening comprises substantially aligning the pouring cup with the first pour tube and, separately, aligning the pouring cup with the second pour tube; wherein the pouring cup is configured to pour the respective volume of molten metal or alloy in the first pour tube and the another respective volume of molten metal or alloy in the second pour tube.

7. The system of claim 1, further comprising at least one of a vacuum chamber controller configured to, under the control of the computing device, at least adjust a pressure within the vacuum chamber, a heating zone controller configured to at least adjust a temperature of a heating zone of the vacuum chamber, or a cooling zone controller configured to at least adjust a temperature of a cooling zone of the vacuum chamber.

8. A method comprising:

substantially aligning a pouring cup with a first surface opening of a plurality of surface openings defined by a mold by moving at least one of the pouring cup or a platform supporting a casting assembly, wherein the casting assembly is configured to hold a plurality of joinable components and the mold, wherein the mold defines at least one mating groove configured to join at least two joinable components of the plurality of joinable components when occupied with a metal or an alloy, wherein each mating groove of the at least one mating groove is fluidically connected to the first surface opening and a second surface opening define by the mold, and wherein a vacuum chamber encloses the pouring cup, the casting assembly, and the platform;

moving the pouring cup to pour a respective volume of molten metal or alloy in the first surface opening separately from the second surface opening;

subsequently substantially aligning the pouring cup with a second surface opening of the plurality of surface openings by moving at least one of the pouring cup and the platform; and moving the pouring cup to pour a respective volume of molten metal or alloy in the second surface opening separately from the first surface opening, wherein the aligning, the pouring, the subsequent aligning, and the moving are controlled by a computing device, wherein the pouring cup is a single pouring cup.

9. The method of claim 8, wherein substantially aligning the pouring cup with the second surface opening comprises at least one of translating or rotating the platform.

10. The method of claim 8, wherein substantially aligning the pouring cup with the second surface opening comprises at least one of translating or rotating the pouring cup.

11. The method of claim 8, wherein the vacuum chamber comprises a heating zone and a cooling zone, further comprising moving the platform supporting the casting assembly between the heating zone and the cooling zone.

12. The method of claim 11, further comprising cooling the molten metal or alloy in the cooling zone to solidify and join the plurality of joinable components.

13. The method of claim 8, wherein substantially aligning the pouring cup with the first surface opening of the plurality of surface openings comprises aligning the pouring cup with a first pour tube of a plurality of pour tubes, wherein each respective pour tube of the plurality of pour tubes is connected to one of the plurality of surface openings.

14. The method of claim 8, further comprising pre-heating the casting assembly to a predetermined temperature.

15. A computer readable storage medium comprising instructions that, when executed, cause at least one processor of a computing device to:

control at least one of a cup controller to move a pouring cup and a platform controller to move a platform supporting a casting assembly to substantially align the pouring cup with a first surface opening of a plurality of surface openings defined by a mold, wherein the casting assembly is configured to hold a plurality of joinable components and the mold, wherein the mold defines at least one mating groove configured to join at least two joinable components of the plurality of joinable components when occupied with a metal or an alloy, each mating groove of the at least one mating groove fluidically connected to the first surface opening and a second surface opening define by the mold, and wherein a vacuum chamber encloses the pouring cup, the casting assembly, and the platform;

control the cup controller to move the pouring cup to pour a respective volume of molten metal or alloy in the first surface opening separately from the second surface opening;

subsequently control at least one of the cup controller to move the pouring cup and the platform controller to move the platform to substantially align the pouring cup with a second surface opening of the plurality of surface openings; and control the cup controller to move the pouring cup to pour a respective volume of molten metal or alloy in the second surface opening separately from the first surface opening, wherein the pouring cup is a single pouring cup.

16. The computer readable storage medium of claim 15, further comprising instructions that, when executed, cause the at least one processor to control the platform controller to substantially align the second surface opening with the pouring cup by at least one of translating or rotating the platform.

17. The computer readable storage medium of claim 15, further comprising instructions that, when executed, cause the at least one processor to control the cup controller to substantially align the pouring cup with the second surface opening by at least one of translating or rotating the pouring cup.

18. The computer readable storage medium of claim 15, further comprising instructions that, when executed, cause the at least one processor to control the platform controller to move the platform supporting the casting assembly between a heating zone and a cooling zone in the vacuum chamber.

19. The computer readable storage medium of claim 18, further comprising instructions that, when executed, cause the at least one processor to control a cooling zone controller to cool the molten metal or alloy in the cooling zone to solidify and join the plurality of joinable components.

* * * * *